US008545128B2

(12) United States Patent
Weiler

(10) Patent No.: US 8,545,128 B2
(45) Date of Patent: Oct. 1, 2013

(54) CONFIGURABLE DESEGREGATION APPARATUS

(75) Inventor: Patrick J. Weiler, Pella, IA (US)

(73) Assignee: Weiler, Inc., Knoxville, IA (US)

( * ) Notice: Subject to any disclaimer, the term of this patent is extended or adjusted under 35 U.S.C. 154(b) by 90 days.

(21) Appl. No.: 13/106,565

(22) Filed: May 12, 2011

(65) Prior Publication Data

US 2012/0288329 A1 Nov. 15, 2012

(51) Int. Cl.
*E01C 19/18* (2006.01)

(52) U.S. Cl.
USPC ..... 404/92; 404/110

(58) Field of Classification Search
USPC ..... 404/92, 101, 108, 110; 222/241
See application file for complete search history.

(56) References Cited

U.S. PATENT DOCUMENTS

| | | | | |
|---|---|---|---|---|
| 1,750,896 | A * | 3/1930 | Lichtenberg | 404/106 |
| 3,519,169 | A * | 7/1970 | Holland | 222/626 |
| 4,830,533 | A * | 5/1989 | Miller | 404/101 |
| 5,622,323 | A * | 4/1997 | Krueger et al. | 241/101.76 |
| 6,899,490 | B2 * | 5/2005 | Lee et al. | 404/101 |
| 7,186,055 | B2 * | 3/2007 | Lee et al. | 404/101 |
| 7,220,079 | B2 * | 5/2007 | Lee et al. | 404/101 |
| 7,244,077 | B2 * | 7/2007 | Lee et al. | 404/75 |
| 7,785,033 | B2 * | 8/2010 | Boyd | 404/75 |
| 7,785,034 | B2 * | 8/2010 | Hood et al. | 404/112 |

* cited by examiner

*Primary Examiner* — Gary Hartmann
(74) *Attorney, Agent, or Firm* — Camille L. Urban; David M. Breiner

(57) ABSTRACT

A desegregation apparatus that desegregates a stream of HMA that includes particles of varying size includes a desegregation hopper, which houses an auger assembly. A series of counter-handed augers is mounted on a shaft disposed within the hopper. Open sections are disposed between adjacent auger sections and above openings in the bottom surface of the hopper.

9 Claims, 7 Drawing Sheets

CONFIGURABLE DESEGREGATION APPARATUS

FIELD OF THE INVENTION

The present invention relates generally to delivery of hot mix asphalt (HMA) for roadbed construction and, more particularly, to an apparatus for desegregating streams of HMA.

BACKGROUND

When a roadbed is to be constructed using hot mix asphalt (HMA), the HMA typically is prepared off-site and transferred to the construction site by a transport machine such as, for example, a dump truck. The HMA, which typically is maintained at a temperature between 300 and 400 degrees Fahrenheit, often is loaded onto the dump truck using an elevator, which conveys the HMA to a spout from which it falls into the truck bed. At the construction site, the HMA can be transferred to a paving machine, which deposits the HMA on the roadbed.

If the HMA is to be temporarily stored at the construction site, the HMA can be transferred from the dump truck to a material transport vehicle (MTV). As the term is used herein, a material transfer vehicle (MTV) refers to any type of machine that can be used to transfer HMA to a paving machine. Exemplary MTVs include remixing transfer vehicles (e.g., "self-propelled" transfer machines that include their own drive system), windrow pickup machines (e.g., "towed" transfer machines that do not include their own drive system), components of paving machines that transfer HMA into the paving machine, and the like.

During such a transfer, the HMA exits a chute at the back of the truck and, in some cases, is transferred into a hopper on the MTV. A windrow elevator conveys the HMA from the hopper either directly into the paving machine or into another hopper, where it is temporarily stored until the paving machine is ready to use it. Alternatively, the dump truck may dump the HMA onto the roadbed, while it moves along the roadbed, thereby creating a windrow. In this case, the windrow is picked up from the roadbed (e.g., by a windrow pickup machine) and transferred to the paving machine.

When the HMA is loaded into truck beds, hoppers, and other containers, the HMA segregates. Additionally, segregation occurs when HMA is unloaded onto a roadbed to create a windrow. Larger, heavier pieces of HMA tend to roll to the outside (e.g., away from the peak) of the resulting piles or windrow (the process known as "segregation"). Moreover, during transportation and temporary storage, the load of HMA often develops temperature variations because the material toward the outside of the container tends to cool faster than the material toward the middle of the container. The amount of segregation and temperature variation in HMA has a negative impact on the roadbed's durability. Thus, HMA typically is desegregated (i.e., re-mixed) prior to its roadbed application. A number of devices such as the examples listed below have been developed to perform the desegregation.

U.S. Pat. No. 5,035,534, to Brock and Smith, for an Apparatus for Transferring an Asphalt-Aggregate Mixture, includes transversely disposed variable pitch screw augers on a single shaft mounted in the bottom of storage hopper. The first screw auger is located on one side of a mid portion of the shaft and the second is located on the other side of a mid portion of the shaft. Each of the screw augers has flights of a first pitch at the outer end of the shaft and flights of a second pitch set inwardly. This arrangement is described as allowing the HMA at the center portion of stream to combine with material transported inwardly to center. The description states that the variable pitches allow different sizes of HMA pieces to be mixed and explains that the mixing occurs due to and in the flights of the pitched augers. The material is mixed in the flights and moved toward the center where it falls through the material outlet underneath a cover.

U.S. Pat. No. 5,405,214, to Campbell, for a Paving Machine Incorporating Automatic Feeder Control Gates, uses a first gate mechanism and a second gate mechanism. Raising one and lowering the other shifts discharged materials to one side; raising and lowering the opposite shifts the material to the other allowing management of the flow along both a vertical and horizontal plane. Some mixing also occurs as a result.

U.S. Pat. No. 5,553,968, to Campbell, for a Method and Apparatus for Conveying and Desegregating Aggregate, uses a different approach. Rather than using adjustable gates to move outer materials to the center for remixing, this one uses a notch in the floor of a first drag slat conveyor. The notch is in the center of the first conveyor floor and positioned near the end of the first conveyance path. The small pieces fall through the notch on to a second conveyor, the large pieces fall later thereby re-orienting the small and large pieces along the direction of the conveyor, rather than outside to inside.

U.S. Pat. No. 5,642,961, to Campbell, for a Method for Conveying and Desegregating Aggregate, is similar to the U.S. Pat. No. 5,553,968 in that it reorients laterally segregated aggregate on a conveyor to a longitudinally segregated aggregate. The aggregate is then desegregated as it comes into contact with and travels along a second conveyor. This is achieved by discharging smaller pieces onto the second conveyor before the larger.

In U.S. Pat. No. 6,007,272, to Macku and Trygg, for an Asphalt Paver with Remixing Conveyor System, describes a paver, which includes a hopper conveyor to move HMA from hopper to screed, as having at least one pair of spaced apart axially rotatable augers. These augers are disposed in the direction of travel. Each auger has a "tapered peripheral diameter" defining a space therebetween as a "remixing zone." U.S. Pat. No. 6,099,205, to Macku and Trygg, for an Asphalt Paver with Remixing Conveyer System, describes a similar apparatus.

U.S. Pat. No. 6,481,922, to Boyd, for an Apparatus and Method for Re-mixing Segregated Material, describes a device wherein the outer portions of a moving HMA stream are moved toward the center via augers. Here, the outer portions of the HMA stream drops through a material outlet with the inner portions of the stream. This patent terms the uncovered center portion of the augers, which is positioned directly over the material outlet, a mixing zone, explaining that this is the area in which mixing of the small and large pieces of HMA occurs.

U.S. Pat. No. 7,160,056, to Hoffman and Swearingen, for a Material Transfer Vehicle for Use in Asphalt Paving, describes a material transfer vehicle having a surge bin for storing HMA prior to paving. The surge bin includes counter-handed remixing augers that tend to move the HMA pieces to the center of the bin for remixing. One outlet is provided for releasing the HMA from the surge bin onto a transfer conveyor.

U.S. Pat. No. 7,785,033, to Boyd, for an Apparatus and Method for Fragmenting and Re-Mixing Agglomerated Pieces of Rubberized Asphalt Material, describes a housing having an auger and tine assembly that rotates within the housing. The assembly includes counter-handed auger sections mounted on a shaft, with a tine section mounted on the shaft between the auger sections. The re-mixed material exits the housing through a single opening disposed below the tine section.

The prior art concepts generally do not adequately accomplish the objectives of remixing the HMA to achieve significantly uniform distribution of large and small particulate HMA. For example, even where the distribution's level of uniformity is improved somewhat, the utility of the achievement is mitigated by the fact that the re-mixed HMA often is distributed in a single stream. As the stream is off-loaded, it forms a pile, and a number of large pieces of HMA will tend to roll to the edges of the pile, thereby re-segregating the HMA to a certain degree, as well as diminishing the uniformity of a roadbed profile of delivered HMA. Further, the level of HMA remixing tends to be inadequate with conventional systems and can often be better characterized as concentrating the stream of HMA pieces of all sizes rather than actually remixing it.

It is a first objective of the invention to improve the level of remixing of HMA prior to its delivery to a roadbed.

It is a second objective of the invention to provide a desegregation apparatus that accomplishes the first objective.

It is a third objective of the invention to provide an output stream of HMA that has a flatter profile.

It is a fourth objective to provide means to better mix both small and large pieces of HMA prior to delivery to the roadbed, thereby remixing the stream of HMA rather than simply concentrating the stream into a more narrow flow pattern.

SUMMARY

This summary is provided to introduce a selection of concepts in a simplified form that are further described below in the Detailed Description. This summary is not intended to identify key features or essential features of the claimed subject matter, nor is it intended to be used, in isolation, as an aid in determining the scope of the claimed subject matter. At a high level, embodiments of the invention relate to desegregating hot mix asphalt (HMA) prior to roadbed application. Embodiments of the invention relate to a desegregation apparatus that desegregates a stream of HMA that includes particles of varying size.

It should be understood that, as the phrase and variations thereof are used herein, "desegregating a stream of HMA" refers to the process of re-mixing segregated HMA to achieve an HMA stream (i.e., "desegregated HMA" stream) that is more uniform in terms of the distribution of small and large pieces of HMA and in terms of temperature variations throughout the stream. Various features of the invention described herein generally offer advantages over the known prior art (e.g., providing a desegregated HMA stream that is more uniform, providing a more uniform roadbed-profile, and the like).

In accordance with embodiments of the invention, a stream of HMA is delivered to a desegregation apparatus. The desegregation apparatus includes a desegregation hopper having at least two sidewalls and a bottom surface. An auger assembly is housed within the desegregation hopper and operates to desegregate the entering stream of HMA. According to embodiments of the invention, the auger assembly includes at least one auger shaft extending generally between the sidewalls and spaced above the bottom surface. Sections of counter-handed auger flights are mounted in a serial relationship along the auger shaft and separated by open sections. The auger sections re-mix the HMA by laterally translating different portions of the HMA stream in opposing directions and toward one of the open sections along the auger shaft.

As the desegregated HMA is moved into the open sections of the auger shaft, it exits the desegregation hopper through a number of configurable openings, which are defined in the bottom surface of the hopper and which can be disposed, for example, below corresponding open sections of the auger shaft. In some embodiments, the locations of the openings are configurable using one or more adjustable lower panels. This arrangement improves mixing as the auger sections move some of the larger pieces of HMA from the outer edges of the stream toward the nearest open sections of the auger shaft and, at the same time, move some of the smaller pieces of the HMA outward from the center of the stream preferably thereby separating and moving various particle sizes from a segregated stream to form mixed, desegregated streams. The pieces of HMA that are deflected by the auger will fall to the hopper below, or may tumble within the hopper until caught by the auger. Those that fall to the hopper bottom will eventually be moved to an opening by virtue of the flow of adjacent pieces. Moreover, the openings on the bottom surface can be spaced apart to deliver a number of desegregated HMA streams that are, in some embodiments, generally parallel, thereby providing a flatter HMA-profile on the roadbed or in the paving machine hopper.

A first illustrative embodiment of the invention relates to an apparatus that desegregates a hot mix asphalt (HMA) stream. According to embodiments of the invention, the apparatus includes a desegregation hopper having a front panel, an opposed rear panel, and two opposed sidewalls. The illustrative embodiment includes mixing means for desegregating the HMA stream to produce a desegregated HMA stream. The mixing means includes an auger assembly that is disposed within the desegregation hopper and that extends generally between an inside surface of the first sidewall and an inside surface of the second sidewall. Other aspects of the first illustrative embodiment include configurable outlet means for releasing the desegregated HMA stream from the desegregation hopper.

A second illustrative embodiment of the invention relates to an apparatus that desegregates a hot mix asphalt (HMA) stream by employing a desegregation hopper. The desegregation hopper includes a front panel, an opposed rear panel, and two opposed sidewalls. An auger assembly is disposed within the desegregation hopper and extends generally between an inside surface of the first sidewall and an inside surface of the second sidewall. According to embodiments of the invention, the auger assembly includes two or more pairs of counter-handed auger flights serially mounted on an outside surface of a rotatable shaft that extends through the desegregation hopper. In embodiments, the illustrative apparatus further includes one or more moveable panels that partially cover the bottom of the desegregation hopper.

A third illustrative embodiment of the invention relates to a desegregation hopper that houses an auger assembly. The auger assembly includes a shaft that is rotatably coupled, at a first end with the inside surface of the first sidewall and that extends through the desegregation hopper. The shaft is rotatably associated, at a second end, with the inside surface of the second sidewall. A first outside auger section, a second outside auger section, and at least one inside auger section are serially mounted on a rotatable shaft that extends through the desegregation hopper. In embodiments, a first open section is disposed between the first outside auger section and the inside auger section and is defined by a first section of the shaft having no auger sections mounted thereon. Similarly, a second open section is disposed between the inside auger section and the second outside auger section and is defined by a first section of the shaft having no auger sections mounted thereon. Various embodiments can also include at least one moveable panel extending between a bottom edge of the front panel and a bottom edge of the rear panel.

These and other aspects of the invention will become apparent to those having skill in the relevant arts upon a reading of the following description, drawings, and claims.

BRIEF DESCRIPTION OF THE DRAWINGS

Embodiments of the invention are described in detail below, with reference to the attached drawing figures, wherein.

DETAILED DESCRIPTION

The subject matter of embodiments of the invention disclosed herein is described with specificity to meet statutory requirements. However, the description itself is not intended to limit the scope of this patent. Rather, the inventors have contemplated that the claimed subject matter might also be embodied in other ways, to include different features or combinations of features similar to the features described in this document, in conjunction with other technologies.

Figure 1A:
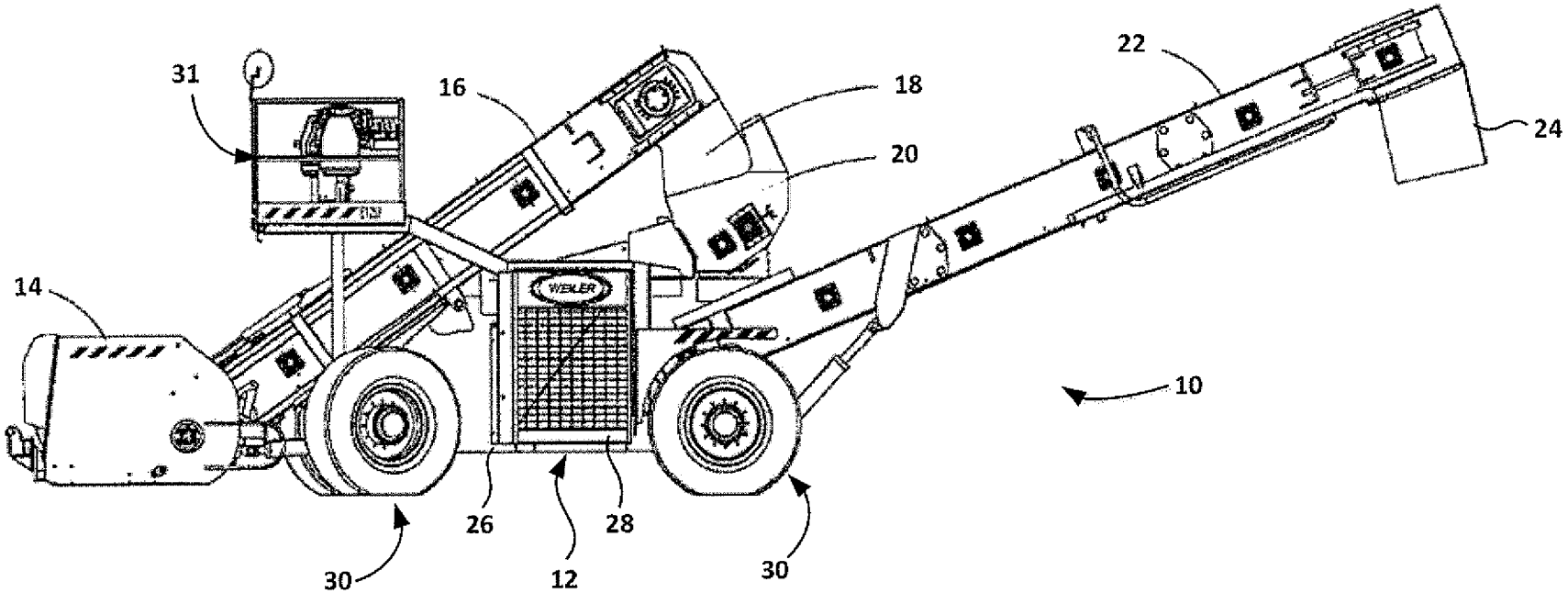
FIG. 1A is a side view of an illustrative remixing transfer vehicle that includes a desegregating apparatus, in accordance with embodiments of the invention.
Figure 1B:
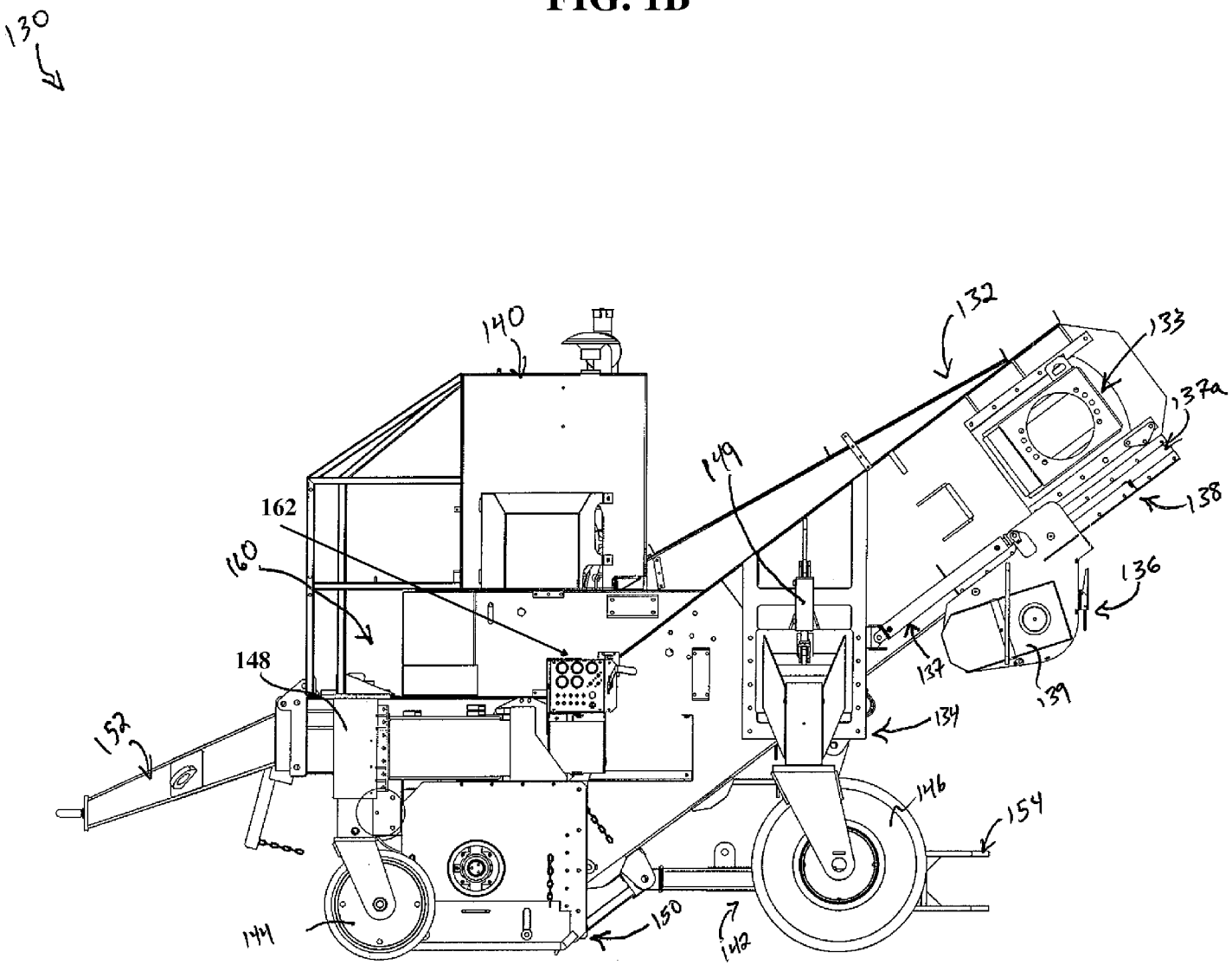
FIG. 1B is a side view of an illustrative windrow pickup machine that includes a desegregating apparatus, in accordance with embodiments of the invention.

Referring to the drawings, and particularly to FIGS. 1A and 1B, two illustrative embodiments 10 and 130 of a material transfer vehicle (MTV) are depicted in side views, respectively. Although other types of machines and configurations could be used, for the purposes of clarity of description, an illustrative remixing transfer vehicle 10 is shown in FIG. 1A and an illustrative windrow pickup machine 130 is shown in FIG. 1B.

With reference to FIG. 1A, the MTV 10, as illustrated, includes a vehicle base 12, upon which is mounted a dump hopper 14 that is located near the lower end of a windrow elevator 16. Near the upper end of the windrow elevator 16, a desegregation chute 18 accepts hot mix asphalt (HMA) from the windrow elevator 16 and guides it into a desegregation apparatus 20. The HMA is released from the desegregation apparatus 20 onto a transfer elevator 22. As illustrated in FIG. 1A, a transfer chute 24 may be located relative to an end of the transfer elevator 22 to guide HMA into a receiving hopper on a paving machine (not illustrated in FIG. 1A for the purposes of clarity and brevity). Exemplary remixing transfer vehicles include, for instance, the E1250A and the E2850 remixing transfer vehicles available from Five Star Industries, Inc., of Knoxville, Iowa.

As depicted in FIG. 1A, the vehicle base 12 includes a vehicle frame 26 that supports an engine 28 and a drive system 30. In the illustrated embodiment, the drive system 30 includes a set of four wheels rotatably mounted to a lower portion of the vehicle base 12 and powered by the engine 28. In other embodiments, the drive system 30 can include any number of additional wheels or other driving means. For example, in some embodiments, the drive system 30 can include a track-drive system. In other embodiments, a combination of wheels and tracks can be used. As is further illustrated in FIG. 1A, the MTV 10 can be controlled from an operator's station 31. In some embodiments, the MTV 10 can be remotely controlled and, as discussed above, in other embodiments, the MTV 10 can be integrated with one or more other types of machines (e.g., paving machines).

Turning to FIG. 1B, a side view of an illustrative windrow pickup machine 130 (also referred to herein as an MTV) is presented in accordance with embodiments of the invention. Exemplary windrow pickup machines include, for instance, the E550A and E650 windrow pickup machines available from Five Star Industries, Inc., of Knoxville, Iowa. As illustrated in FIG. 1, the illustrative windrow pickup machine 130 includes a windrow elevator apparatus 132 coupled to a vehicle base 134. In embodiments, the windrow elevator apparatus 132 can be driven by motors disposed within the vehicle base 134. In other embodiments, as illustrated in FIG. 1B, the windrow elevator apparatus 132 can be driven by a direct-drive motor 133 mounted on the elevator windrow apparatus 132.

As is further illustrated in FIG. 1B, the illustrative windrow pickup machine 130 includes an illustrative desegregation apparatus 136 and a windrow elevator apparatus 132. According to various embodiments of the invention, the illustrative desegregation apparatus 136 is similar to the desegregation apparatus 20 described with reference to FIG. 1A, and FIGS. 2-5. As shown in FIG. 1B, the desegregation apparatus 136 can be slideably coupled to an underside of the windrow elevator apparatus 132. For example, a hydraulic cylinder device 137 can facilitate sliding the desegregation apparatus 136 along guide members 137*a* coupled to the underside of the windrow elevator apparatus 132. In this manner, the desegregation apparatus 136 (which, in embodiments, can be driven by a motor 139 attached thereto), can be selectively positioned below an opening 138 in the underside of the upper end of the windrow elevator apparatus 132 or retracted for ease of operation relative to various other tasks and equipment. In other embodiments, the desegregation apparatus 136 can be pivotably coupled to the windrow elevator apparatus 132, removeably coupled to the windrow elevator apparatus 132, or fixedly coupled to the windrow elevator apparatus 132. In still further embodiments, the desegregation apparatus 136 can be integrated into a portion (e.g., near the upper end) of the windrow elevator apparatus 132.

With continued reference to FIG. 1B, the illustrative windrow pickup machine 130 further typically includes an engine compartment 140 that houses an engine and any number of additional components and a suspension assembly 142. According to various embodiments, the suspension assembly 142 can include, for example, a three-point suspension system that includes front wheels 144 and rear wheels 146. In some embodiments, as shown in FIG. 1B, the suspension assembly 142 can include a hydraulic cylinder 148 associated with each front wheel 144 and one or more hydraulic cylinders 149 associated with each rear wheel 146. In this manner, for example, some embodiments of the illustrative windrow pickup machine 130 can allow for independent height adjustment of one or more of the wheels.

As is further depicted in FIG. 1B, the illustrative windrow pickup machine 130 includes a material feed system 150 that operates to pick windrow up from the roadbed and provide the windrow to the windrow elevator apparatus 132. The illustrative windrow pickup machine 130 also includes a front hitch 152 and a rear hitch 154. In embodiments, for example, the front hitch 152 can be pivotably coupled to the front of the vehicle base 134 so that it can be moved out of the way, if necessary. In some embodiments, the rear hitch 154 can be slideably coupled to the rear of the vehicle base 134 and can be used, for example, to couple the windrow pickup machine 130 to a paving machine or the like.

Figure 2:
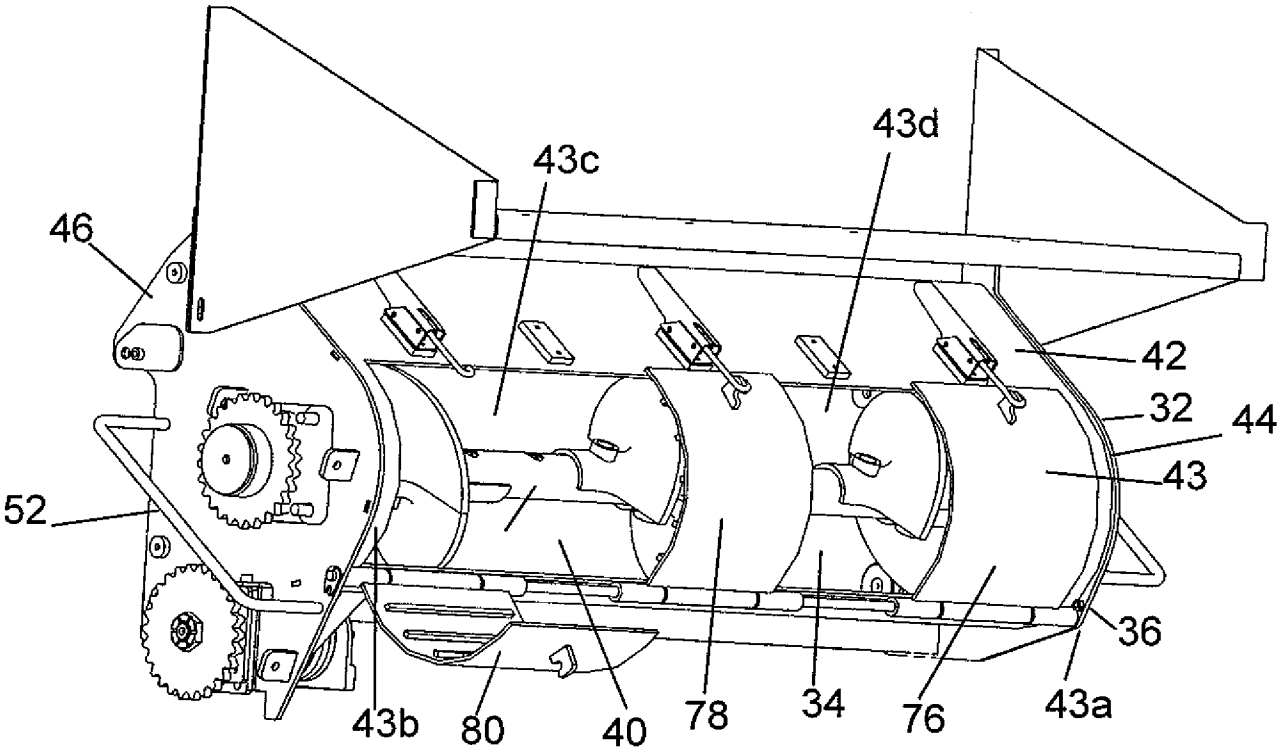
FIG. 2 is a perspective view from below a desegregating apparatus, in accordance with embodiments of the invention.
Figure 3:
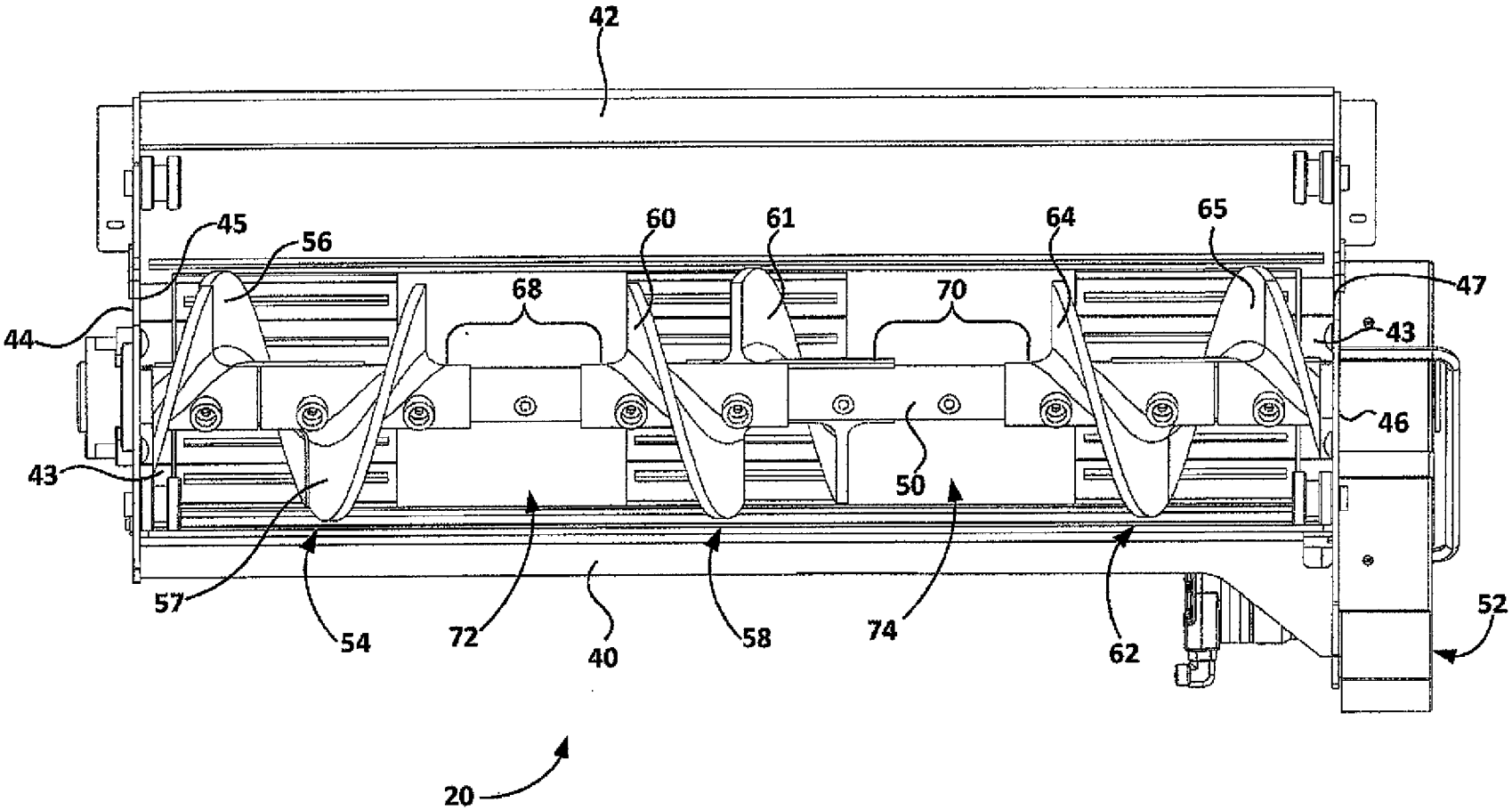
FIG. 3 is a top-plan view of a desegregating apparatus, in accordance with embodiments of the invention.

Turning now to FIGS. 2 and 3, an illustrative desegregation apparatus 20 is illustrated in accordance with embodiments of the invention. The desegregation apparatus 20 is generally positioned below an upper end of a windrow elevator 16 such that an HMA stream that is transferred through the windrow elevator 16 drops into the desegregation apparatus 20. In some embodiments, the desegregation apparatus 20 is pivotably attached to the upper end of the windrow elevator 16. In other embodiments such as, for example, the embodiment illustrated in FIG. 1, the desegregation apparatus 20 is pivotably attached to the bottom of a chute 18, which extends from the upper end of the windrow elevator 16. In still further embodiments, the desegregation apparatus 20 can be positioned below the upper end of the windrow elevator 16, but with no coupling thereto. For example, in an embodiment, the desegregation apparatus includes a hopper that can be used to temporarily store the HMA (e.g., a surge bin). All such configurations are considered to be within the ambit of the invention.

As illustrated in FIGS. 2 and 3, the desegregation apparatus 20 includes a desegregation hopper 32, means 34 for mixing the HMA (referred to herein as "mixing means" 34), and means 36 for letting the HMA out of the desegregation hopper 32 (referred to herein as "outlet means" 36). In embodiments, the desegregation apparatus 20 can include any number of other features or characteristics in addition to those described herein.

The desegregation hopper 32 includes a front panel 40, an opposed rear panel 42, a first sidewall 44, and a second sidewall 46. According to embodiments, the front panel 40, the rear panel 42, and the sidewalls 44 and 46 define an enclosure, with openings at the top and bottom. In the illustrated embodiments, the top of the desegregation hopper 32 can be open; however, alternative implementations of the invention can include partially covering the top of the desegregation hopper 32 such as, for example, by including a cover having one or more inlets defined therein.

In some embodiments, the front panel 40 and rear panel 42 can be substantially parallel and, in other embodiments (such as in the embodiment illustrated in FIG. 2), the front and rear panels 40 and 42 can be oriented at an angle with respect to one another such that, for example, the top of the desegregation hopper 32 is wider than the bottom. Similarly, in some embodiments, the sidewalls 44 and 46 can be substantially parallel (such as, for example, is illustrated in FIGS. 2 and 3) while, in other embodiments, the sidewalls 44 and 46 can be oriented at an angle with respect to one another. According to some embodiments of the invention, the desegregation hopper 32 includes more than two sidewalls 44 and 46.

Figure 4:
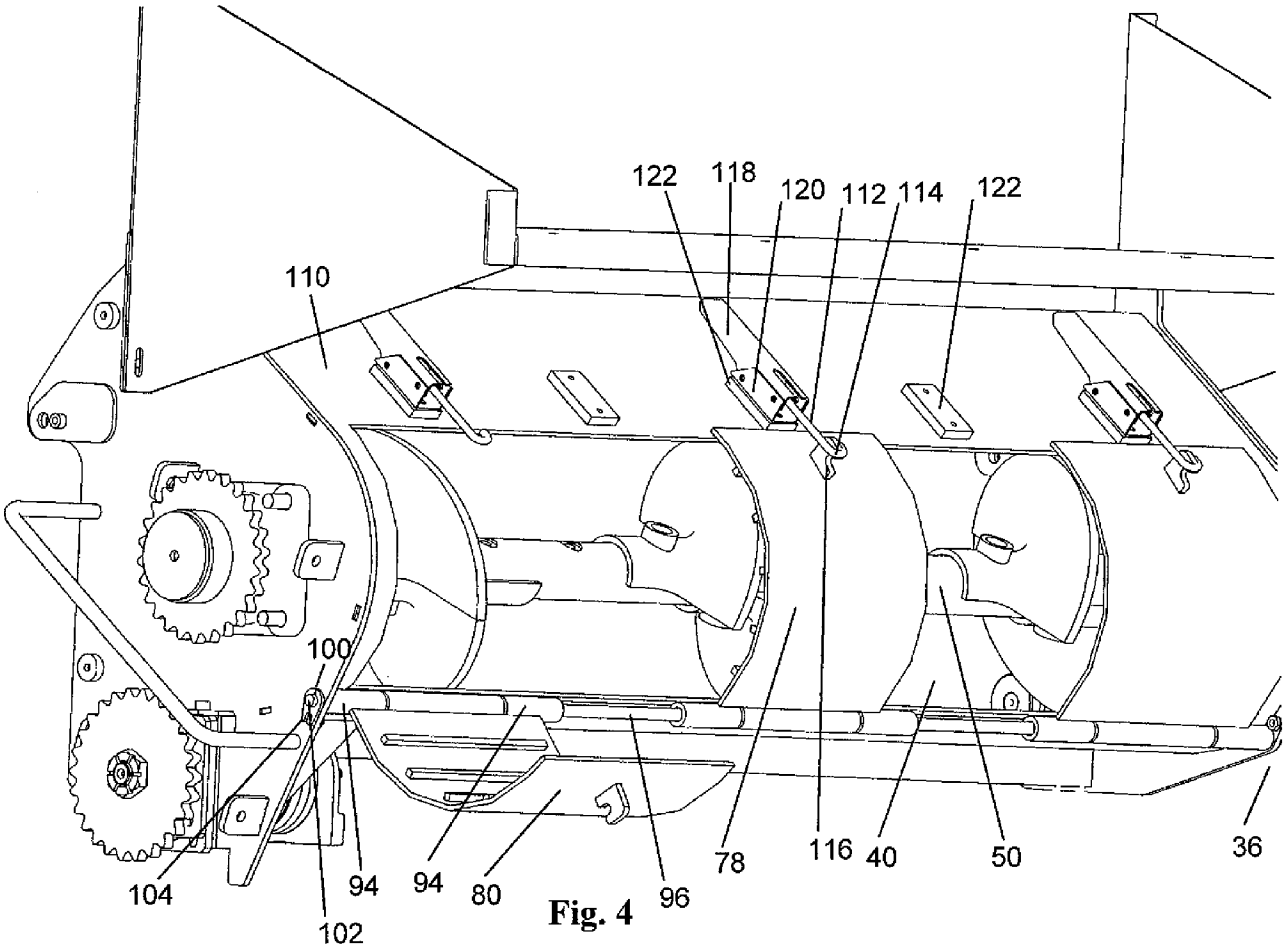
FIG. 4 a close-up, perspective view from below a desegregating apparatus, in accordance with embodiments of the invention.

Additionally, as is further illustrated in FIGS. 2-4, the desegregation hopper 32 can include a bottom surface 43 that partially defines the bottom of the desegregation hopper 32. As depicted, the bottom surface 43 can include a flange portion 43*a* and 43*b*, extending from the bottom edge of each sidewall 44 and 46, respectively. In some embodiments, the flange portions 43*a* and 43*b* can be integral to the sidewalls 44 and 46 and, in other embodiments, the flange portions 43*a* and 43*b* can be (fixedly or removeably) attached at or near the bottom edge of each sidewall 44 and 46. As described in more detail below, and with particular reference to FIGS. 4 and 5, the bottom surface 43 further includes one or more adjustable lower panels 76, 78, and 80.

As individuals having skill in the relevant arts will appreciate, when HMA (not illustrated herein for the purposes of clarity and brevity) is introduced to the desegregation hopper 32 from above, the HMA encounters the mixing means 34. In accordance with various embodiments of the invention, the mixing means 34 is operable to desegregate (e.g., re-mix) the HMA before it exits the desegregation hopper 32 from openings in the bottom surface 43. To accomplish desegregation of the HMA, the mixing means 34 generally employs an auger assembly 35 that moves larger, heavier pieces of HMA that have shifted to an outside edge of the HMA stream toward one of at least two openings, which are referenced by numerals 43*c* and 43*d* in FIG. 2.

With particular reference to FIG. 3, the mixing means 34 includes an auger assembly 35 that is disposed within the desegregation hopper 32. The auger assembly 35 includes an auger shaft 50 that rotates relative to an inside surface 45 of the first sidewall 44 and extends through the desegregation hopper 32 generally to or near an inside surface 47 of the second sidewall 46. The auger shaft 50 is situated within the desegregation hopper 32 such that it can rotate. In embodiments, the auger shaft 50 is driven by an auger-drive motor 52, which, as illustrated in FIG. 2, can be mounted to an outside surface 53 of the second sidewall 46. The motor 52 may be positioned in any way that allows power to be translated to the auger shaft.

In the embodiments depicted in FIG. 3, the auger assembly 35 further includes three auger sections 54, 58, and 62, which are mounted upon the auger shaft 50. As illustrated, the auger sections 54 and 62 are each located near an end of the auger shaft 50 (i.e., toward the outside of the desegregation hopper 32) and are referred to herein as "outside auger sections" 54 and 62. Each outside auger section 54 and 62 is configured with an orientation such that they tend to move larger pieces of HMA away from the sidewalls 44 and 46, respectively, and are, accordingly, counter-handed with respect to each other. The auger section 58 is mounted to a portion of the auger shaft 50 that is disposed between the outside auger sections 54 and 62 and is therefore referred to as an "inside auger section." According to embodiments, any number of inside auger sections can be disposed between the two outside auger sections 54 and 62 so long as each pair of consecutive auger sections is counter handed.

Figure 6:
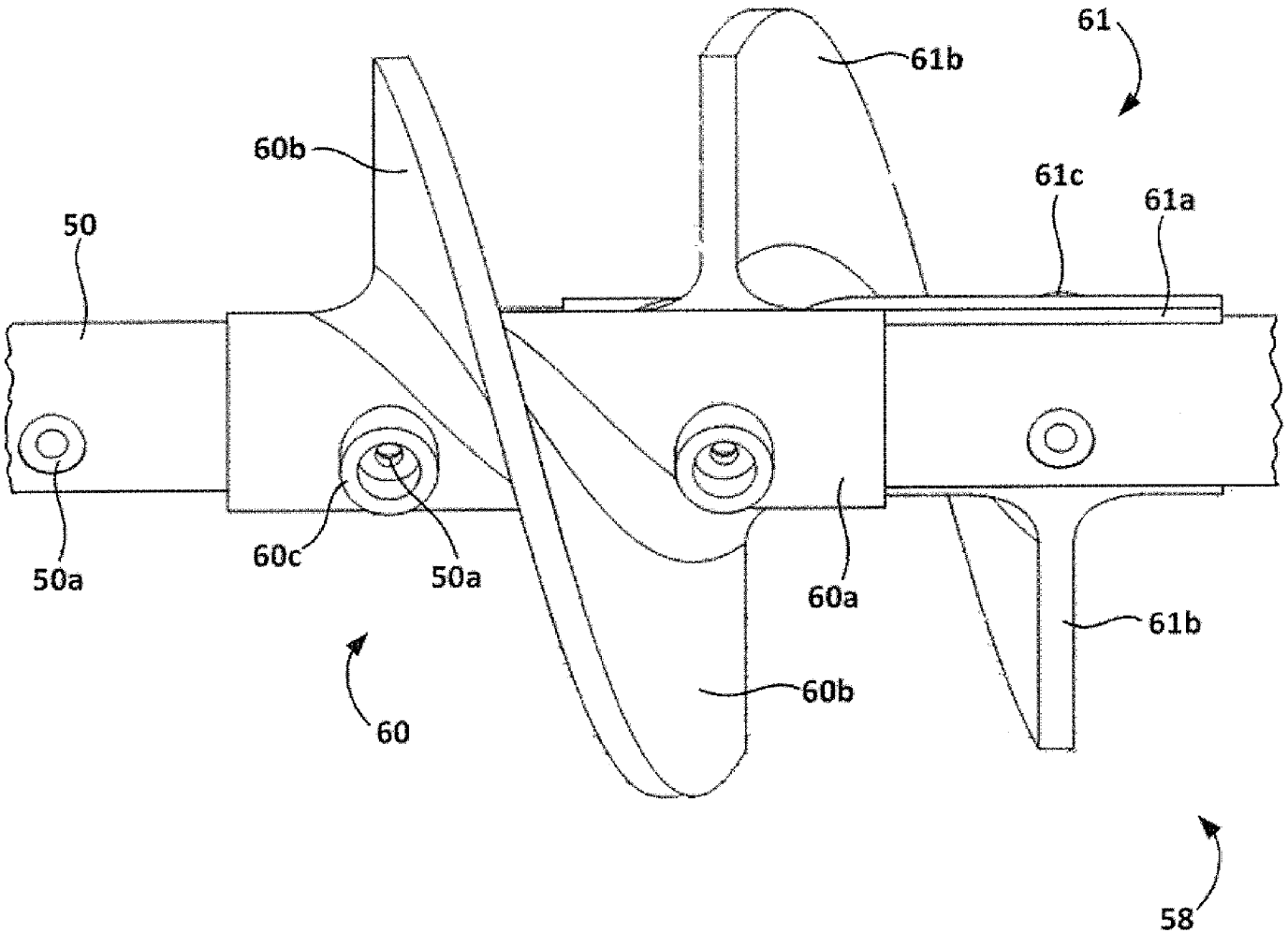
FIG. 6 is a close-up, top view of an inside auger section having counter-handed auger flights in accordance with embodiments of the invention.

As is illustrated in FIG. 3, each auger section 54, 58, and 62 includes a set of auger flights 56 and 57, 60 and 61, and 64 and 65, respectively. Turning briefly to FIG. 6, a close-up view of the inside auger section 58 is depicted, showing the flights 60 and 61 therein. As illustrated in FIG. 6, inside auger section 58 includes two auger flights 60 and 61. Each of the auger flights 60 and 61 includes a mounting plate 60*a* and 61*a*, respectively, and an auger blade 60*b* and 61*b*, respectively. In embodiments, the mounting plates 60*a* and 61*a* are designed such that they can be coupled to the auger shaft 50 at a desired location. For example, in embodiments in which the auger shaft 50 is a cylindrical shaft, each mounting plate 60*a* and 61*a* is curved such that the mounting plate 60*a* or 61*a* wraps partially around the auger shaft 50. In some embodiments, each mounting plate 60*a* and 61*a* is configured such that it wraps halfway around the auger shaft 50, thereby allowing a user to mount various auger flights to desired locations on the auger shaft 50 without the mounting plates 60*a* and 61*a* interfering with the placement of one another. The mounting plates 60*a* and 61*a* can be coupled to the auger shaft 50 using fasteners 60*c* and 61*c*, respectively, that engage holes 50*a* disposed within the auger shaft 50 or by other means known in the art. According to various embodiments, the fasteners 60*c* and 61*c* can be any type of suitable fastener known in the art such as, for example, nuts, bolts, pins, and the like.

The auger blades 60*b* and 61*b* are fixed to the outside of the mounting plate 60*a* and 61*a*, respectively. In accordance with various embodiments of the invention, auger blades 60*b* and 61*b* can be constructed according to any number of various configurations. That is, for example, in some embodiments, auger blades 60*b* and 61*b* can have varying depths (e.g., radial distances from the auger shaft 50 to the outside edge of the auger blades 60*b* and 61*b*), various frequencies (e.g., the number of turns about the axis defined by the auger shaft 50), various pitches, and the like.

In embodiments of the invention, the auger shaft 50 is provided with open sections 68 and 70, which are sections of the auger shaft 50 that do not have auger sections mounted thereon. For example, in the embodiment depicted in FIG. 3, the illustrative auger assembly 34 includes a first open auger section 54, an inside auger section 58, and a second outside auger section 62. The first outside auger section 54 and the inside auger section 58 are separated by a first open section 68, which is illustrated as a first section of the auger shaft 50 having no auger sections mounted thereon. Similarly, the inside auger section 58 and the second outside auger section 62 are separated by a second open section 70, which is illustrated as a second section of the auger shaft 50 having no auger sections mounted thereon.

As is illustrated in FIGS. 3 and 6, the auger flights 60 and 61 are counter-handed in orientation with respect to one another. In operation, then, auger flight 60 moves material toward a first, adjacent open section 68, while the auger flight 61 moves material toward a second, adjacent open section 70. Similarly, the first outside auger section 54 moves material toward the first open section 68, while the second outside auger section 62 moves material toward the second open section 70. This configuration provides for effective division and lateral movement of HMA pieces of all sizes thereby mixing pieces of an HMA stream. According to various embodiments of the invention, any desirable number of inside auger sections, (which may include pairs of counter-handed auger flights), can be mounted in a spaced, serial relationship along the auger shaft 50.

Figure 5:
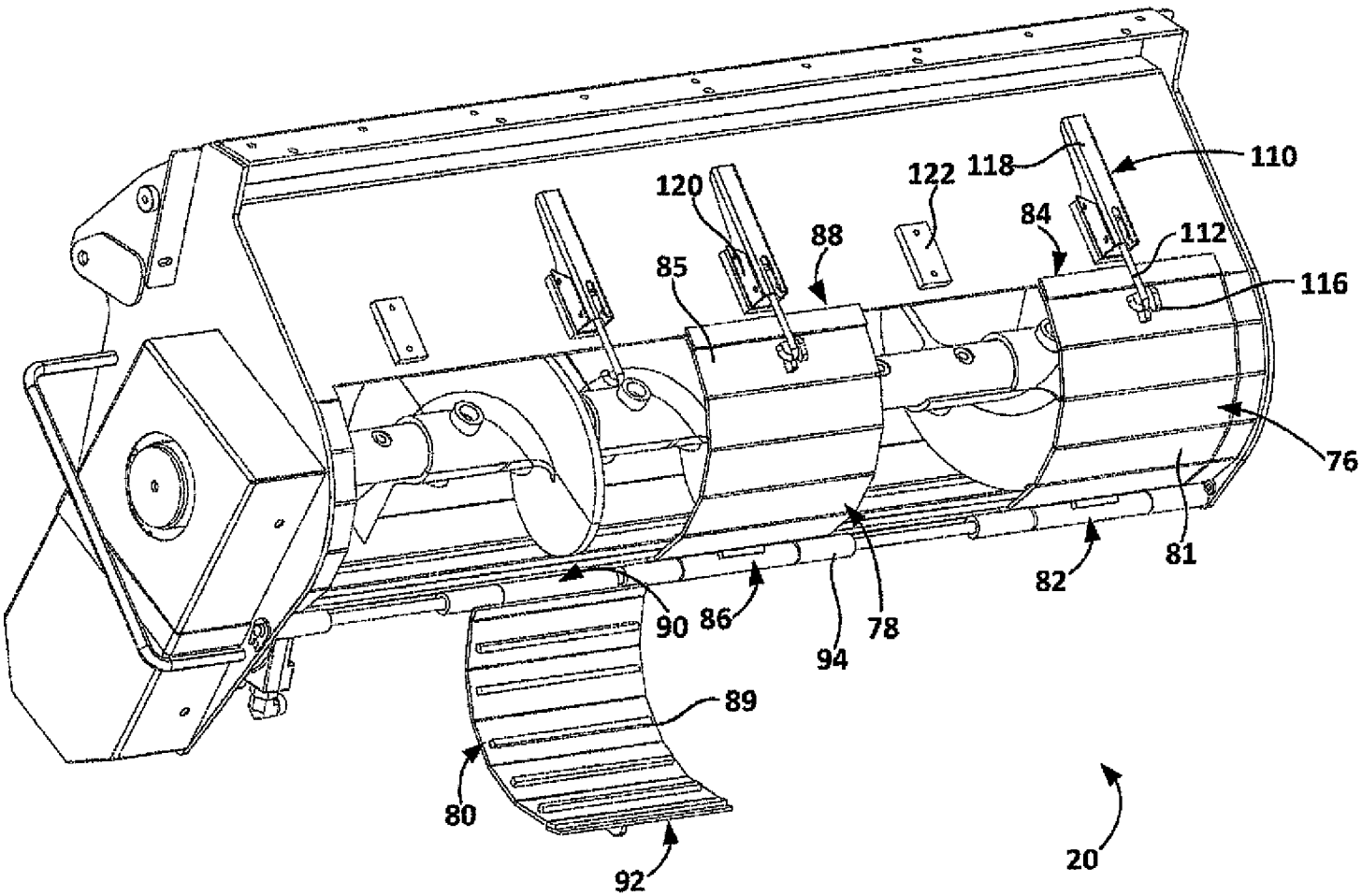
FIG. 5 is another perspective view from below a desegregating apparatus, in accordance with embodiments of the invention.

In some embodiments, as depicted in FIGS. 3-5, each open section 68 and 70 is disposed above an opening in the bottom surface 43 of the desegregation hopper 32. Additionally, each open section 68 and 70 can correspond to a mixing region 72 and 74, respectively. The mixing regions 72 and 74 are, according to embodiments of the invention, defined by an interior region of the desegregation hopper 32 surrounding an open section, into which the auger sections move pieces of the HMA stream for mixing with other pieces of the HMA stream. In some embodiments, a number of open sections of the auger shaft can be disposed above a single opening in the bottom surface 43 of the desegregation hopper 32 and, in still further embodiments, a single open section can be disposed above a number of openings in the bottom surface 43 of the desegregation hopper 32. In accordance with embodiments of the invention, the openings in the bottom surface 43 are configurable and their configuration is achieved using outlet means 36.

As depicted in the drawings, the outlet means 36 includes at least one and preferably a plurality of panels 76, 78, and 80. In embodiments of the invention, the panels 76, 78, and 80 can be removably and/or slidably coupled, at a first respective end 82, 86, and 90, to the bottom edge of the front panel 40. The panels can be coupled to the front panel 40 using any number of removable and/or adjustable coupling means 94. Coupling means 94 can, as depicted in FIGS. 4 and 5, be a hinge assembly, that includes one or more pins 96 that can be slid through guides 94*a* mounted to the bottom edge of the front panel 40 and the first end 82, 86, and 90 of each panel 76, 78, and 80. As illustrated, the pins 96 are held into place at an outside end 102 using any number of suitable fastening mechanisms such as a flanged bushing 100 that includes a cut-away portion that engages a nut 104. In some embodiments, the flanged bushing 100 can be configured to engage a plug, which, in some cases, can be spring-loaded. Other types of fastening mechanisms can be used in implementing features of the invention, as well.

Additionally, as is further illustrated in FIGS. 4 and 5, the panels 76, 78, and 80 are removeably coupled, at a second respective end 84, 88, and 92 to the bottom edge of the rear panel 42 using a removable coupling means 110. The removable coupling means 110 can include a removable latch 118 that can be closed into a bracket 120 to apply tension to a pin 112. An engagement section 114 on the end of the pin 112 engages an engagement section 116 mounted onto the respective body 81, 85, and 89 of the panel 76, 78, and 80. Furthermore, in embodiments, the bracket 120 can be removeably coupled to a mounting bracket 122 using any number of suitable mechanisms. For example, in some embodiments, bracket 120 includes flanges that engage corresponding troughs defined along the side edges of the mounting bracket 122. In this manner, the bracket 120 can be slid onto and off of the mounting bracket 122, which may include a stop (not illustrated) at a bottom edge to hold the bracket 120 in place. In other embodiments, any number of other mounting mechanisms can be used such as, for example, screws, nuts and bolts, keys, clips, and the like.

In operation, the mixing means 34 is powered by an auger-drive motor 52 and, in operation, the auger-drive motor 52 rotates the auger shaft 50 about its axis. This rotation, in turn, causes the auger sections 54, 58, and 62 to rotate and mix the segregated HMA, producing a desegregated HMA stream. The outlet means 36 are operable to further control the roadbed-profile of the HMA stream. In this manner, the desegregation apparatus 10 of the invention allows for some degree of control over the roadbed-profile of the HMA as it exits the desegregation hopper 32 and is distributed by a paving machine. The desegregated HMA stream exits the desegregation hopper 32 via the outlet means 36. The configurable openings of the outlet means 36 allow the hopper to deliver the desegregated HMA streams either closer together or further apart, depending, for example, on a project's parameters, while retaining the advantage of a thoroughly re-mixed HMA stream, as well as obtaining a more uniform roadbed profile of the delivered HMA streams.

The present invention has been described in relation to particular embodiments, which are intended in all respects to be illustrative rather than restrictive. Alternative embodiments will become apparent to those having skill in the art to which the invention pertains, without departing from its scope.

From the foregoing, it will be seen that this invention is one well-adapted to attain all the ends and objects set forth above, together with other advantages which are obvious and inherent to the system. It will be understood that certain features and subcombinations are of utility and may be employed without reference to other features and subcombinations. This is contemplated by, and is within the scope of, the claims.

The invention claimed is:

1. An apparatus that desegregates a hot mix asphalt (HMA) stream, the apparatus comprising:

a) a desegregation hopper comprising a front panel, an opposed rear panel, having a plurality of removable coupling members attached thereto, and two opposed sidewalls, wherein a first sidewall extends between a first end of the front panel and a first end of the rear panel, and wherein the second sidewall extends between a second end of the front panel and a second end of the rear panel;

b) mixing means for desegregating the HMA stream to produce a desegregated HMA stream, the mixing means comprising an auger assembly that is disposed within the desegregation hopper and that extends generally between an inside surface of the first sidewall and an inside surface of the second sidewall; and c) outlet means for releasing the desegregated HMA stream from the desegregation hopper while controlling a roadbed-profile of the HMA by causing the HMA stream to exit through at least one configurable opening defined in a bottom surface of the desegregation hopper, wherein the outlet means further includes a plurality of movable panels, each of said panels extending between a bottom edge of the front panel and a bottom edge of the rear panel, each of the three movable panels being configured to connect to the plurality of removable coupling members and at least one pin sliding through at least one guide mounted on a bottom edge of the front panel, wherein the plurality of movable panels are configured to at least one of be removable from the at least one pin and translate along the at least one pin.

2. The apparatus of claim 1, wherein the auger assembly includes a shaft that is rotatably coupled, at a first end, to the inside surface of the first sidewall and extends through the desegregation hopper, wherein the shaft is rotatably coupled, at a second end, to the inside surface of the second sidewall.

3. The apparatus of claim 2, wherein the auger assembly further includes at least three auger sections serially mounted on an outside surface of the shaft, each auger section having one or more auger flights.

4. The apparatus of claim 3, wherein at least two of the one or more auger flights are counter-handed with respect to each other.

5. The apparatus of claim 3, wherein the at least three auger sections include a first outside auger section that is disposed near the first end of the auger shaft, a second outside auger section that is disposed near the second end of the auger shaft, and an inside auger section that is disposed between the first and second outside auger sections.

6. The apparatus of claim 5, wherein the first outside auger section and the inside auger section are separated from each other by a first open section, the first open section comprising a first section of the shaft having no auger sections mounted thereon, and wherein the inside auger section and the second outside auger section are separated from each other by a second open section, the second open section comprising a second section of the shaft having no auger sections mounted thereon.

7. The apparatus of claim 6, wherein the first open section corresponds to a first mixing region and wherein the second open section corresponds to a second mixing region.

8. The apparatus of claim 5, wherein the outlet means further includes at least three moveable panels, each of said panels extending between a bottom edge of the front panel and a bottom edge of the rear panel.

9. An apparatus that desegregates a hot mix asphalt (HMA) stream, the apparatus comprising:

a) a desegregation hopper comprising a front panel having a bottom edge, an opposed rear panel having a bottom edge, and two opposed sidewalls, wherein a first sidewall extends between a first end of the front panel and a first end of the rear panel, and wherein the second sidewall extends between a second end of the front panel and a second end of the rear panel;

b) mixing means for desegregating the HMA stream to produce a desegregated HMA stream, the mixing means comprising an auger assembly that is disposed within the desegregation hopper and that extends generally between an inside surface of the first sidewall and an inside surface of the second sidewall; and c) outlet means for releasing the desegregated HMA stream from the desegregation hopper while controlling a roadbed-profile of the HMA comprising at least one configurable opening defined between the bottom edges of the front panel and the opposed rear panel of the desegregation hopper, and at least one movable panel also extending generally between the bottom edges of the front panel and of the rear panel, and a plurality of coupling members, wherein said movable panel may be secured by said at least one of said coupling members in a first position, and unsecured and moved laterally along said bottom edges of the front panel and rear panel to any one of a plurality of other positions and secured in said one of a plurality of other positions by at least one of said plurality of coupling members to adjust the flow of the desegregated HMA stream and control said roadbed profile.

* * * * *